US008220527B2

(12) United States Patent
Liu et al.

(10) Patent No.: US 8,220,527 B2
(45) Date of Patent: Jul. 17, 2012

(54) HEAT DISSIPATION DEVICE WITH HEAT PIPE

(75) Inventors: Peng Liu, Shenzhen (CN); Shi-Wen Zhou, Shenzhen (CN); Chun-Chi Chen, Taipei Hsien (TW); Yi-Jiun Li, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 1147 days.

(21) Appl. No.: 12/056,295

(22) Filed: Mar. 27, 2008

(65) Prior Publication Data

US 2009/0242176 A1 Oct. 1, 2009

(51) Int. Cl.
*F28D 15/02* (2006.01)

(52) U.S. Cl. ..... 165/80.3; 165/104.21

(58) Field of Classification Search ..... 165/80.1, 165/80.3, 104.21, 104.33; 361/697, 700
See application file for complete search history.

(56) References Cited

U.S. PATENT DOCUMENTS

| | | | | |
|---|---|---|---|---|
| 7,100,681 | B1 * | 9/2006 | Wu et al. | 165/104.33 |
| 2008/0202729 | A1 * | 8/2008 | Mochizuki | 165/104.14 |
| 2008/0210404 | A1 * | 9/2008 | Peng | 165/80.3 |

FOREIGN PATENT DOCUMENTS

TW M317746 U 8/2007

* cited by examiner

*Primary Examiner* — Teresa Walberg
(74) *Attorney, Agent, or Firm* — Altis Law Group, Inc.

(57) ABSTRACT

A heat dissipation device includes a heat spreader for thermally engaging with a heat generating electronic device, a heat sink assembly located above the heat spreader, and first and second heat pipes connecting with the heat spreader and the heat sink assembly. Each of the first and second heat pipes comprises an evaporation section engaged in the heat spreader, two arc-shaped condensation sections thermally inserted in the heat sink assembly, and two connecting sections interconnecting corresponding condensation sections and the evaporation section. The condensation sections are coplanar with each other and located in a same circle. The condensation sections of the first heat pipe extend in a clockwise direction, while the condensation sections of the second heat pipe extend in an anticlockwise direction.

19 Claims, 3 Drawing Sheets

HEAT DISSIPATION DEVICE WITH HEAT PIPE

BACKGROUND OF THE INVENTION

1. Field of the Invention

The present invention relates to heat dissipation devices, and particularly to a heat dissipation device having a heat pipe for cooling an electronic component, such as an integrated circuit package.

2. Description of Related Art

Electronic components, such as central processing units (CPUs) comprise numerous circuits operating at high speed and generating substantial heat. Under most circumstances, it is necessary to cool the CPUs in order to maintain safe operating conditions and assure that the CPUs function properly and reliably. In the past, various approaches have been used to cool electronic components. Typically, a finned metal heat sink is attached to an outer surface of the CPU to remove the heat therefrom. The heat absorbed by the heat sink is then dissipated to ambient air. The related finned metal heat sink is made of highly heat-conductive metal, such as copper or aluminum, and generally comprises a base for contacting the CPU to absorb the heat therefrom and a plurality of fins formed on the base for dissipating the heat. However, as the operating speed of electronic components has increased markedly in recent years, such a related heat sink, which transfers the heat only by metal conduction, is not competent for dissipating so much heat any more. The heat of the bottom of the metal heat sink can not be transferred to the whole heat dissipation device quickly, and especially can not be transferred to the fins far away from the bottom of the metal heat sink.

Heat pipes, which operate by phase change of working liquid sealed in a hollow pipe, have been widely used due to their excellent heat transfer properties. Accordingly, heat dissipation devices equipped with heat pipes are devised in various manners and widely used. How to enable the heat dissipation device equipped with heat pipes to have an optimal performance becomes a goal that persons skilled in the art endeavor to achieve.

Accordingly, what is needed is a heat dissipation device with heat pipes which has an enhanced heat dissipation performance.

SUMMARY OF THE INVENTION

A heat dissipation device includes a heat spreader for thermally engaging with a heat generating electronic device, a heat sink assembly located above the heat spreader, and two heat pipes connecting with the heat spreader and the heat sink assembly. Each of the heat pipes includes an evaporation section engaged in the heat spreader, two arc-shaped condensation sections thermally inserted in the heat sink assembly, and two connecting sections interconnecting corresponding condensation sections and the evaporation section. The condensation sections are coplanar with each other and located in a same circle. The heat produced by the electronic device is transferred to the heat sink assembly via the two heat pipes each have two arced condensation sections; thus, the heat dissipation device in accordance with the present invention can have an enhanced heat dissipation capability.

Other advantages and novel features of the present invention will become more apparent from the following detailed description when taken in conjunction with the accompanying drawings.

BRIEF DESCRIPTION OF THE DRAWINGS

Many aspects of the present heat dissipation device can be better understood with reference to the following drawings. The components in the drawings are not necessarily drawn to scale, the emphasis instead being placed upon clearly illustrating the principles of the present heat dissipation device. Moreover, in the drawings, like reference numerals designate corresponding parts throughout the several views.

DETAILED DESCRIPTION OF THE INVENTION

Figure 1:
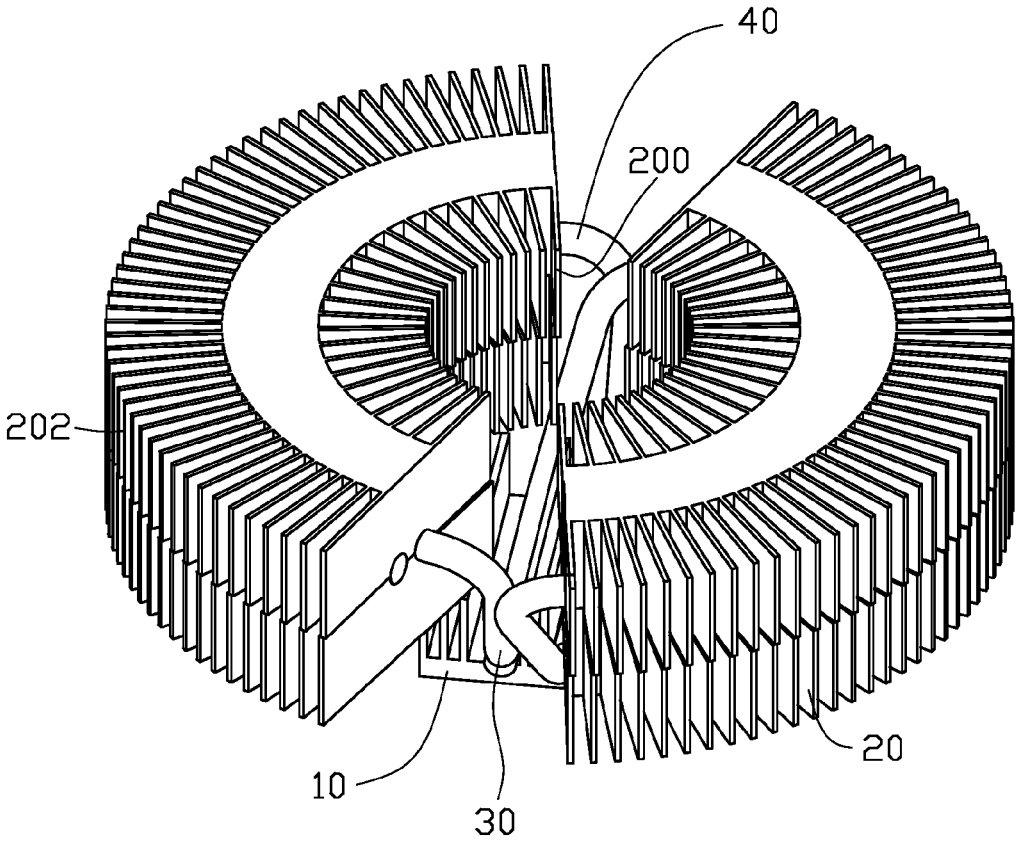
FIG. 1 is an assembled, isometric view of a heat dissipation device in accordance with a preferred embodiment of the present invention.
Figure 2:
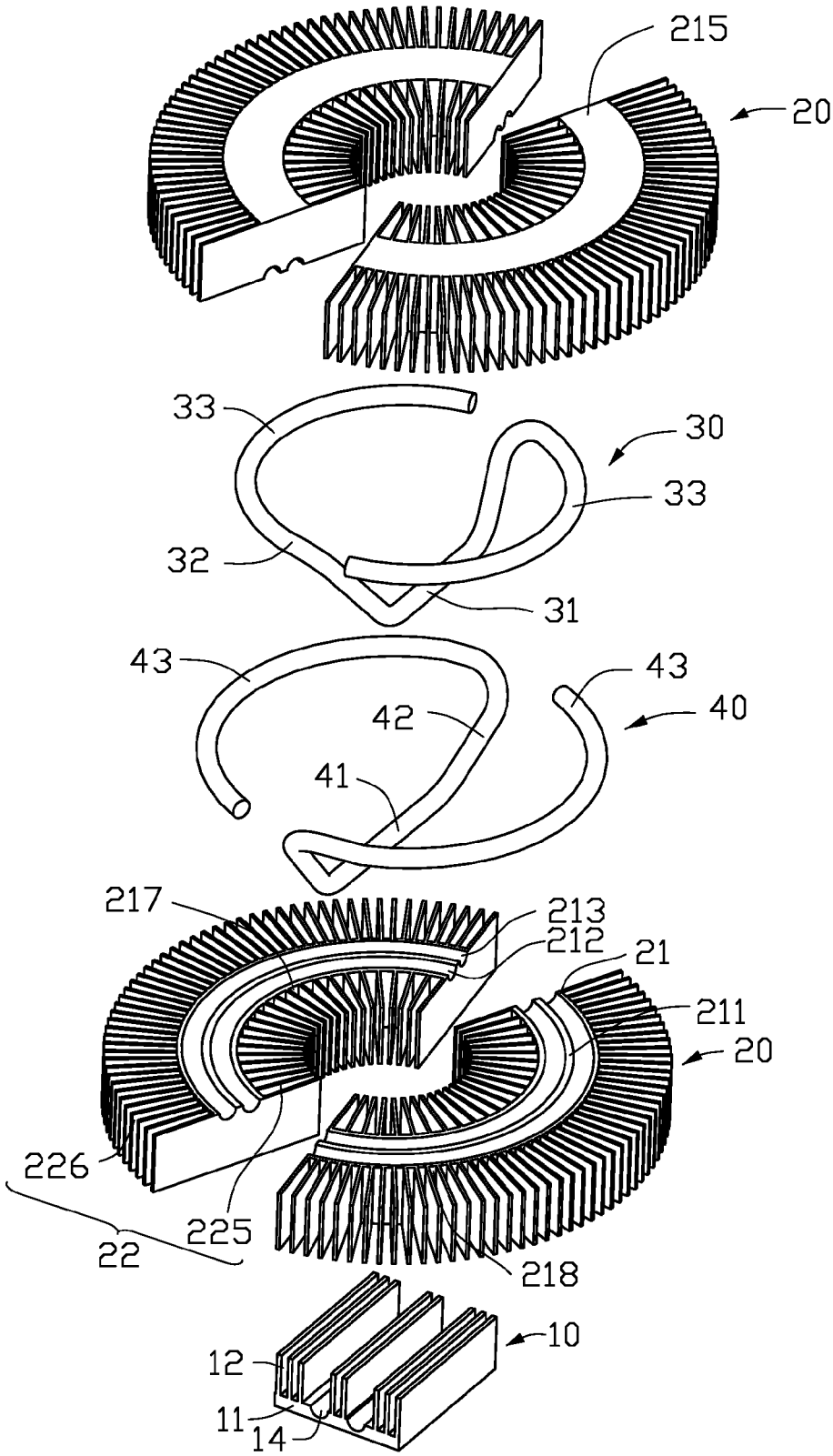
FIG. 2 is an exploded view of FIG. 1.

Referring to FIGS. 1-2, a heat dissipation device is provided for dissipating heat generated by an electronic component (not shown) mounted on a printed circuit board (not shown). The heat dissipation device comprises a heat spreader 10 thermally contacting with the electronic component, a heat sink assembly (not labeled) comprising four heat sinks 20 located above the heat spreader 10, and first and second heat pipes 30, 40 thermally connecting the heat spreader 10 and the heat sink assembly.

The heat spreader 10 is located at a bottom of the heat sink assembly. The heat spreader 10 comprises a base 11 and a plurality of fins 12 extending upwardly from a top of the base 11. The base 11 is substantially rectangular and made of metal with a high degree of heat conductivity, such as copper or aluminum. Two spaced grooves 14 are parallel to each other and defined in an upper portion of the base 11 for receiving the first and second heat pipes 30, 40. The grooves 14 are parallel to the fins 12 and located between the fins 12.

The heat sink assembly comprises four heat sinks 20. The heat sinks 20 each have the same configuration. The heat sink assembly is divided two groups. Each group comprises two superposed heat sinks 20. Each heat sink 20 has an arced inner surface 200 and an arced outer surface 202. The inner surfaces 200 of the heat sinks 20 cooperatively construct a part of an inner circle. The outer surfaces 202 of the heat sinks 20 cooperatively construct a part of an outer circle which is concentric with the inner circle. Each heat sink 20 is formed by aluminum extrusion and comprises a solid arced body 21. A radian of the body 21 is less than 180 degrees. The body 21 has a first flat surface 211 and a second flat surface 215 parallel and opposite to the first flat surface 211. Two spaced, arced grooves 212, 213 are defined at the first flat surface 211. The body 21 has an outer face 218 and an interior face 217 opposite to the outer face 218. A plurality of fins 22 extends radially from the body 21, wherein the fins 22 comprise a plurality of outer fins 226 extending outwardly and perpendicularly from the outer face 218 and a plurality of interior fins 225 extending inwardly from the interior face 217. Inner ends of the interior fins 225 of the heat sinks 20 define the inner surfaces 200 of the heat sinks 20. Outer ends of outer fins 226 of the heat sinks 20 define the outer surfaces 202 of the heat sinks 20. Top and bottom surfaces (not labeled) of the fins 22 are respectively coplanar with the first flat surface 211 and the second flat surface 215 of the body 21. The fins 22 are spaced from each other with a predetermined distance; thus, a plurality of airflow passages (not labeled) is defined between the fins 22.

The first heat pipe 30 is bent to have a straight evaporation section 31 received in a corresponding groove 14 of the base 11, two coplanar and arc-shaped condensation sections 33, and two connecting sections 32 interconnecting corresponding condensation sections 33 and the evaporation section 31. The two connecting sections 32 extend upwardly and slantwise from opposite ends of the evaporation section 31. The two condensation sections 33 are located above the evaporation section 31 and extend from free ends of the two connecting sections 32 along a clockwise direction. The condensation sections 33 each have an approximately semicircular configuration so that free ends of the condensation sections 33 are respectively adjoining to the connecting sections 32. The condensation sections 33 are coplanar with each other and cooperatively construct a part of a circle. In other words, the condensation sections 33 are located in a same circle.

The second heat pipe 40 is substantially similar to the first heat pipe 30 and comprises a straight evaporation section 41 received in the other groove 14 of the base 11, two coplanar and arc-shaped condensation sections 43, and two connecting section 42 interconnecting corresponding condensation sections 43 and the evaporation section 41. The condensation sections 43 are located above the evaporation section 41. The condensation sections 43 extend from free ends of the two connecting sections 42 along an anti-clockwise direction, opposite to the extending direction of the condensation sections 33. The condensation sections 43 are coplanar with each other and cooperatively construct a part of a circle. In other words, the condensations 43 are located in a same circle. The circle constructed by the condensation sections 43 of the second heat pipe 40 has a radius larger than that of the circle constructed by the condensation sections 33 of the first heat pipe 30.

Figure 3:
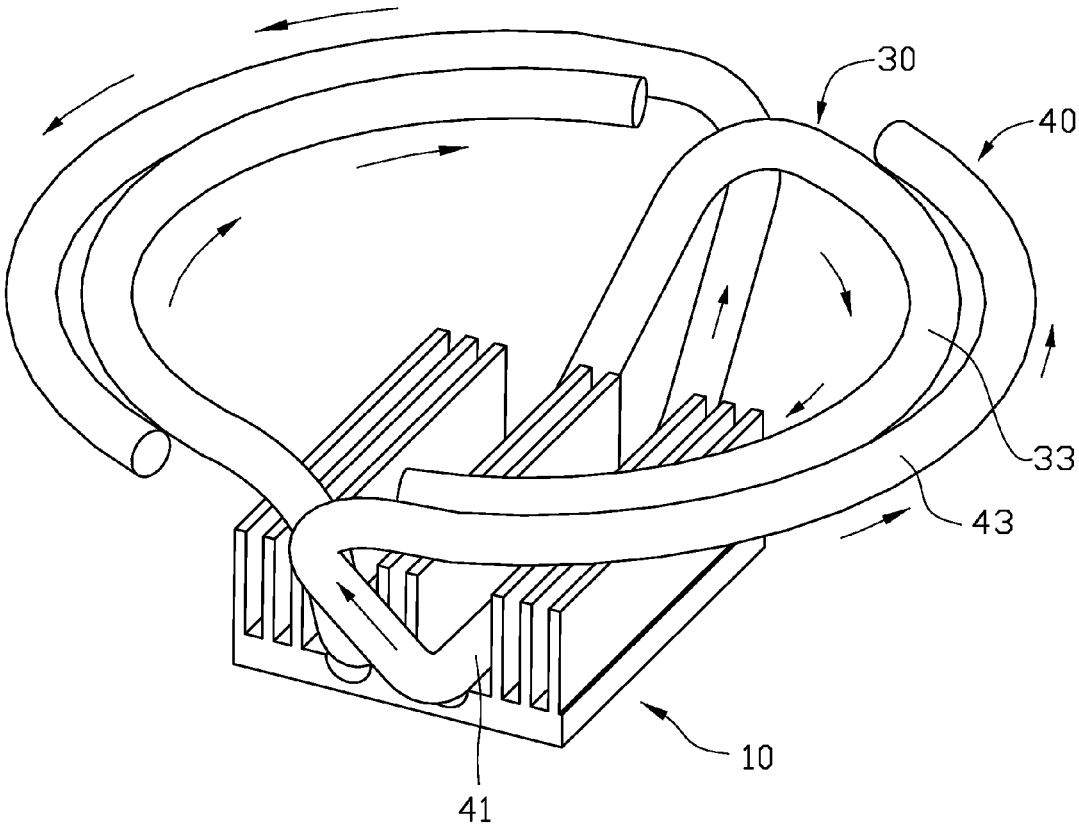
FIG. 3 is an assembled view of a heat spreader, a first heat pipe and a second heat pipe of the heat dissipation device of FIG. 1.

In assembly of the heat dissipation device, the evaporation sections 31, 41 of the first and second heat pipes 30, 40 are thermally received in the grooves 14 of the base 11 of the heat spreader 10 and parallel to each other. Referring also to FIG. 3, the condensation sections 33, 43 of the first and second heat pipes 30, 40 are located in a same plane. One of the connecting sections 32 of the first heat pipe 30 is intercrossed with a corresponding one of the connecting sections 42 of the second heat pipe 40. One condensation section 33 of the first heat pipe 30 is juxtaposed with and inside of a corresponding condensation section 43 of the second heat pipe 40. The condensation sections 33, 43 are received in channels (not labeled) cooperatively formed by the grooves 212, 213, respectively, after the four heat sinks 20 are soldered with each other and sandwich the condensation sections 33, 43 therebetween. Two heat sinks 20 are located at top of the condensation sections 33, 43 and other two heat sinks 20 are located at bottom of the condensation sections 33, 43. The condensation sections 33, 43 are thermally engaged in the channels defined by arced grooves 212, 213 of the heat sinks 40. Free ends of the interior fins 225 surround a through hole in the center of the heat sink assembly.

In use of the heat dissipation device, the base 11 of the heat spreader 10 absorbs heat from the electronic device to which the base 11 is attached. The heat in the base 11 is absorbed by the evaporation sections 31, 41 of the first and second heat pipes 30, 40 and is then transferred to the heat sinks 20 via the connecting sections 32, 42 and the condensation sections 33, 43 of the first and second heat pipes 30, 40. The heat in the heat sinks 20 is subsequently dissipated to ambient air via the fins 22.

In the present invention, since each of the first and the second heat pipes 30, 40 is formed by bending an integrative straight heat pipe to have two arc-shaped condensation sections, the first and second heat pipes 30, 40 of the present invention can function generally equal to four heat pipes regarding the heat transferring capability. And since the condensation sections 33, 43 each have arc-shaped and coplanar with each other, the heat in the first and second heat pipes 30, 40 can be evenly transferred to the heat sinks 20. In addition, the heat sink assembly comprises four same heat sinks 20 which are made by a same mould; thus, cost of the heat dissipation device according to the present invention can be lowered and assembly of the heat dissipation device according to the present invention can be simplified. Furthermore, a route along which the heat is transferred in the condensation sections 33 is inverse with a route along which the heat is transferred in the condensation sections 43. Thus, the heat can be evenly transferred to the whole heat sink assembly.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A heat dissipation device, comprising:

a heat spreader;

a heat sink assembly located above the heat spreader;

a heat pipe comprising an evaporation section engaged in the heat spreader, two arc-shaped condensation sections thermally inserted in the heat sink assembly, and two connecting sections interconnecting corresponding condensation sections and the evaporation section, the condensation sections being coplanar with each other and located in a same circle; and an additional heat pipe, the additional heat pipe comprising an evaporation section engaged in the heat spreader, two arc-shaped condensation sections thermally inserted in the heat sink assembly, and two connecting sections interconnecting corresponding condensation sections and the evaporation section of the additional heat pipe, the condensation sections of the additional heat pipe being coplanar with each other and located in a same circle;

wherein the circle where each condensation section of the additional heat pipe is located has a radius larger than that of the circle where each condensation section of the heat pipe is located.

2. The heat dissipation device as described in claim 1, wherein the condensation sections of the heat pipe and the additional heat pipe are located in a plane.

3. The heat dissipation device as described in claim 1, wherein the condensation sections of the heat pipe extend from free ends of the connecting sections of the heat pipe along a clockwise direction, and the condensation sections of the additional heat pipe extend from free ends of the connecting sections of the additional heat pipe along an anti-clockwise direction.

4. The heat dissipation device as described in claim 3, wherein the connecting sections of the heat pipe and the additional heat pipe slantwise extend from the evaporation sections of the heat pipe and the additional heat pipe, respectively, the connecting sections of the heat pipe being inclined to the connecting sections of the additional heat pipe.

5. The heat dissipation device as described in claim 1, wherein the heat sink assembly comprises four heat sinks, and each two heat sinks thermally sandwich one condensation section of the heat pipe.

6. The heat dissipation device as described in claim 5, wherein each heat sink comprises an arc-shaped solid body and a plurality of outer fins extending outwardly from an outer circumferential face of the body and a plurality of interior fins extending inwardly from an interior circumferential face of the body.

7. The heat dissipation device as described in claim 6, wherein the fins extend radially from the body.

8. A heat dissipation device comprising:

a heat spreader adapted for contacting with a heat-generating electronic component;

a heat sink assembly mounted over the heat spreader, having four arced channels defined therein, the heat sink assembly forming a part of a circle and having a body and a plurality of outer fins extending radially outwardly from the body and a plurality of inner fins extending radially inwardly from the body;

a first heat pipe having a middle evaporation section thermally connecting with the heat spreader and two condensation sections extending clockwise and received in two of the arced channels; and a second heat pipe having a middle evaporation section thermally connecting with the heat spreader and two condensation sections extending anticlockwise and received in the other two of the arced channels;

wherein one of the condensation sections of the first heat pipe is juxtapose with and inside of a corresponding one of the condensation sections of the second heat pipe.

9. The heat dissipation device of claim 8, wherein the first heat pipe has two connection sections interconnecting the evaporation section and the condensation sections of the first heat pipe, and the second heat pipe has two connection sections interconnecting the evaporation section and the condensation sections of the second heat pipe, one of the connection sections of the first heat pipe being crossed with a corresponding one of the connection sections of the second heat pipe.

10. The heat dissipation device as described in claim 8, wherein the condensation sections of the first heat pipe are coplanar with each other and located in a same circle, the condensation sections of the second heat pipe being coplanar with each other and located in a same circle, the circle where each condensation section of the additional heat pipe is located having a radius larger than that of the circle where each condensation section of the heat pipe is located.

11. The heat dissipation device as described in claim 8, wherein the heat sink assembly comprises four heat sinks, and each two heat sinks thermally sandwich one condensation section of the heat pipe, the four arced channels being respectively defined in the heat sinks 12. The heat dissipation device as described in claim 11, wherein each heat sink comprises an arc-shaped solid body and a plurality of outer fins extending outwardly from an outer circumferential face of the body and a plurality of interior fins extending inwardly from an interior circumferential face of the body.

13. A heat dissipation device, comprising:

a heat spreader;

a heat sink assembly located above the heat spreader;

a first heat pipe comprising an evaporation section thermally connecting with the heat spreader, and an arc-shaped condensation section thermally connecting with the heat sink assembly, the condensation section being located in a same circle; and a second heat pipe comprising an evaporation section thermally connecting with the heat spreader, and an arc-shaped condensation section thermally connecting with the heat sink assembly, the condensation section being located in a same circle;

wherein the circle where the condensation section of the second heat pipe is located has a radius larger than that of the circle where the condensation section of the first heat pipe is located.

14. The heat dissipation device as described in claim 13, wherein the condensation section of the first heat pipe is juxtapose with and inside of the condensation section of the second heat pipe.

15. The heat dissipation device as described in claim 13, wherein the condensation section of the first heat pipe extends clockwise and the condensation section of the second heat pipe the extends anticlockwise.

16. The heat dissipation device as described in claim 13, wherein the condensation sections of the first heat pipe and the second heat pipe are located in a plane.

17. The heat dissipation device as described in claim 13, wherein the heat sink assembly comprises two heat sinks thermally sandwiching the condensation sections of the first heat pipe and the second heat pipe.

18. The heat dissipation device as described in claim 17, wherein the each heat sink comprises an arc-shaped solid body and a plurality of outer fins extending outwardly from an outer circumferential face of the body and a plurality of interior fins extending inwardly from an interior circumferential face of the body.

19. The heat dissipation device as described in claim 18, wherein the fins extend radially from the body.

* * * * *